US006666455B1

(12) United States Patent
Dow

(10) Patent No.: US 6,666,455 B1
(45) Date of Patent: Dec. 23, 2003

(54) BASEBALL BOARD AND TRIVIA GAME

(76) Inventor: James M. Dow, 7481 Mitch Owens Road, Unit 25, Ottawa, Ontario (CA), K1T 3N4

( * ) Notice: Subject to any disclaimer, the term of this patent is extended or adjusted under 35 U.S.C. 154(b) by 0 days.

(21) Appl. No.: 10/122,161

(22) Filed: Apr. 15, 2002

(51) Int. Cl.[7] ..... A63F 3/00

(52) U.S. Cl. ..... 273/244.1; 273/259; 273/277; 273/298

(58) Field of Search ..... 273/244, 244.1, 273/244.2, 259, 277, 298, 429–31; D21/356

(56) References Cited

U.S. PATENT DOCUMENTS 4,000,897 A * 1/1977 York ..... 273/244.2
4,776,593 A * 10/1988 DiPersio et al. ..... 463/43
5,746,431 A * 5/1998 McIntyre et al. ..... 273/247

* cited by examiner

*Primary Examiner*—Benjamin H. Layno
*Assistant Examiner*—V Mendiratta

(57) ABSTRACT

A baseball board and trivia game for providing fun and entertainment for baseball enthusiasts. The baseball board and trivia game includes a game board having a top side and further having a simulated diamond-shaped playing field diagrammed upon said top side and including simulated first, second and third bases and a simulated home base being diagrammed upon the simulated diamond-shaped playing field; and also includes decks of playing cards including a first deck of playing cards each having a baseball trivia question and answer displayed upon a side thereof, and also including a second deck of playing cards each having a particular baseball play outcome being displayed upon a side thereof; and further includes a plurality of game pieces being movably positioned upon the game board.

3 Claims, 2 Drawing Sheets

BASEBALL BOARD AND TRIVIA GAME

BACKGROUND OF THE INVENTION

1. Field of the Invention

The present invention relates to baseball trivia games and more particularly pertains to a new baseball board and trivia game for providing fun and entertainment for baseball enthusiasts.

2. Description of the Prior Art

The use of baseball trivia games is known in the prior art. More specifically, baseball trivia games heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,856,780; U.S. Pat. No. 5,762,337; U.S. Pat. No. Des. 340,746; U.S. Pat. No. 5,186,467; U.S. Pat. No. 6,209,872; and U.S. Pat. No. 5,901,956.

While these devices fulfill their respective, particular objectives and requirements, the aforementioned patents do not disclose a new baseball board and trivia game. The prior art includes inventions having game boards and cards and game pieces for moving upon the game boards.

SUMMARY OF THE INVENTION

The general purpose of the present invention, which will be described subsequently in greater detail, is to provide a new baseball board and trivia game which has many of the advantages of the baseball trivia games mentioned heretofore and many novel features that result in a new baseball board and trivia game which is not anticipated, rendered obvious, suggested, or even implied by any of the prior art baseball trivia games, either alone or in any combination thereof. The present invention includes a game board having a top side and further having a simulated diamond-shaped playing field diagrammed upon said top side and including simulated first, second and third bases and a simulated home base being diagrammed upon the simulated diamond-shaped playing field; and also includes decks of playing cards including a first deck of playing cards each having a baseball trivia question and answer displayed upon a side thereof, and also including a second deck of playing cards each having a particular baseball play outcome being displayed upon a side thereof; and further includes a plurality of game pieces being movably positioned upon the game board. None of the prior art includes inventions combining selection of trivia questions with the selection of play outcomes.

There has thus been outlined, rather broadly, the more important features of the baseball board and trivia game in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new baseball board and trivia game which has many of the advantages of the baseball trivia games mentioned heretofore and many novel features that result in a new baseball board and trivia game which is not anticipated, rendered obvious, suggested, or even implied by any of the prior art baseball trivia games, either alone or in any combination thereof.

Still another object of the present invention is to provide a new baseball board and trivia game for providing fun and entertainment for baseball enthusiasts.

Still yet another object of the present invention is to provide a new baseball board and trivia game that is easy and fun to play by anybody having baseball knowledge.

Even still another object of the present invention is to provide a new baseball board and trivia game that would be played like that of a real baseball game which allows the players to learn more about the game of baseball.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
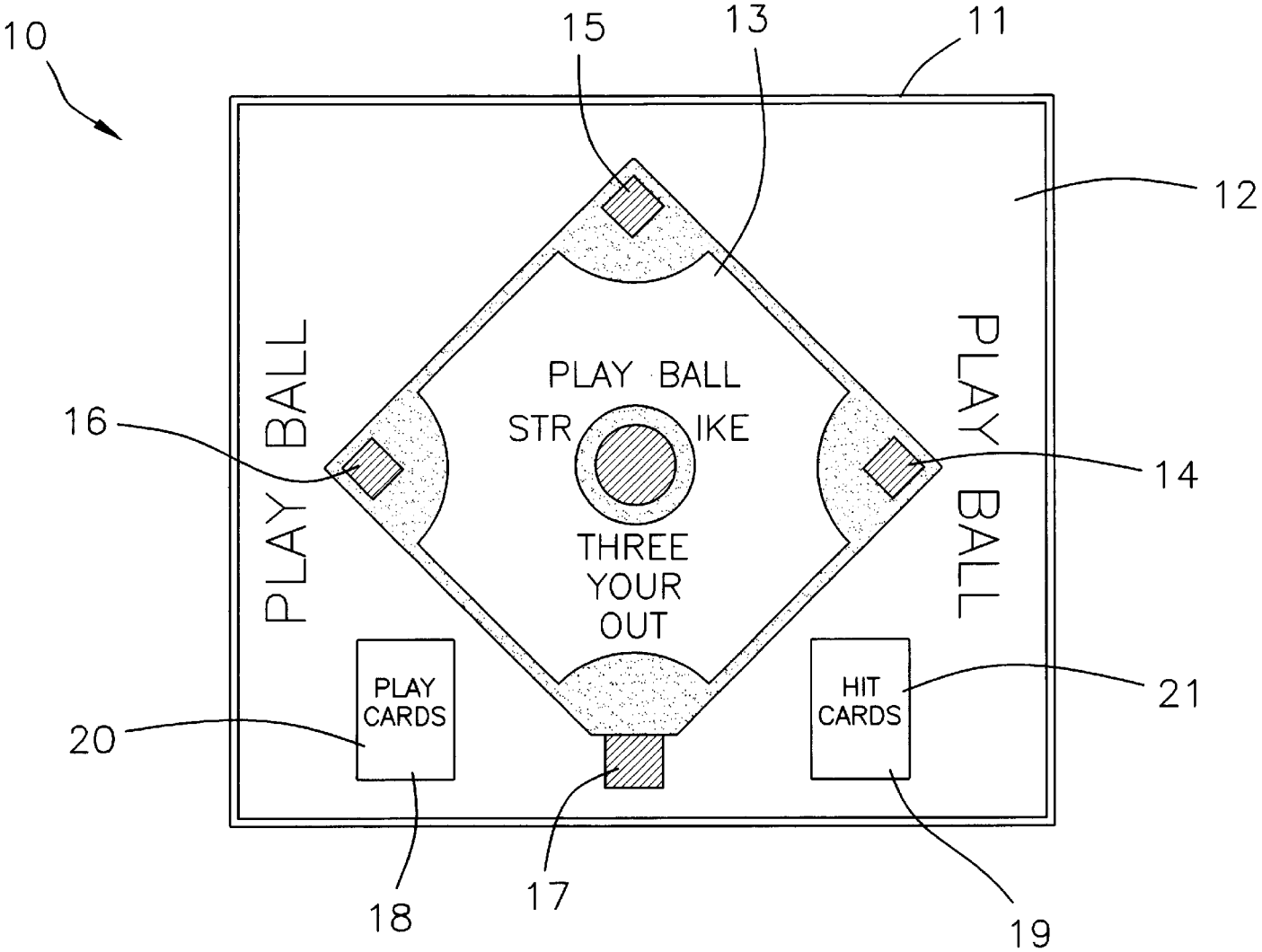
FIG. 1 is a top plan view of a new baseball board and trivia game according to the present invention.
Figure 2:
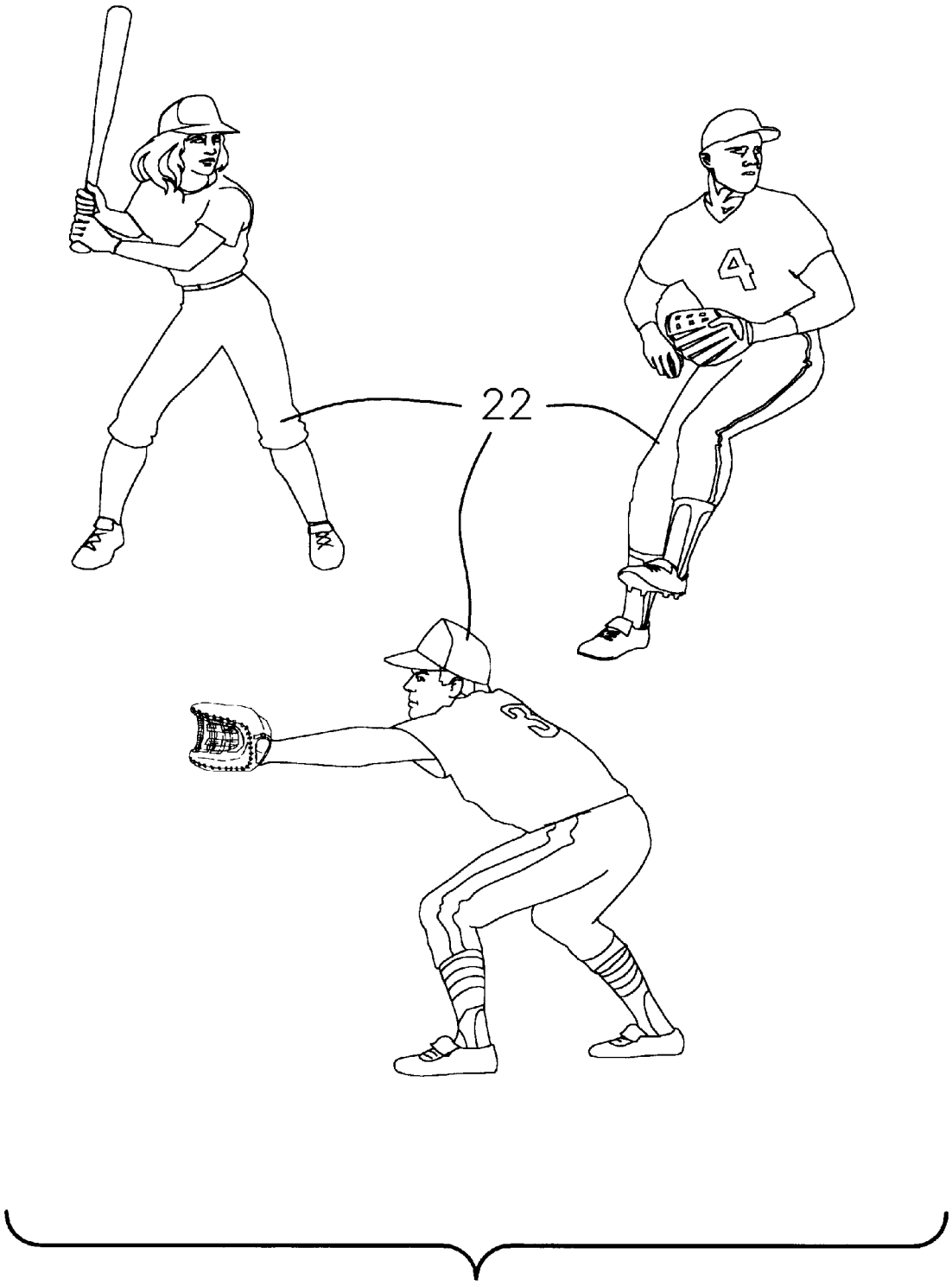
FIG. 2 is a side elevational view of game pieces of the present invention.

With reference now to the drawings, and in particular to FIGS. 1 through 2 thereof, a new baseball board and trivia game embodying the principles and concepts of the present invention and generally designated by the reference numeral 10 will be described.

As best illustrated in FIGS. 1 through 2, the baseball board and trivia game 10 generally comprises a game board 11 having a top side 12 and further having a simulated diamond-shaped playing field 13 conventionally diagrammed upon the top side 12 and including simulated first, second and third bases 14–16 and a simulated home base 17 being conventionally diagrammed upon the simulated diamond-shaped playing field 13.

Decks of playing cards 20,21 include a first deck of playing cards 20 each having a baseball trivia question and answer displayed upon a .side thereof, and also include a second deck of playing cards 21 each having a particular baseball play outcome being displayed upon a side thereof. The game board 11 further includes designated deck placement areas 18,19 being conventionally displayed upon the top side 12 of the game board 11. The second deck of playing cards 21 include indicia indicating the particular baseball play outcome such as a strike, out, single, double, triple, and home run.

A plurality of game pieces 22 are movably positioned upon the game board 11. The game pieces 22 are baseball player figurines having game action posters and being positionable upon the simulated diamond-shaped playing field 13.

In use, a player first selects a card from the first deck of playing cards 20, and answers the baseball trivia question correctly and moves on to a next step or incorrectly and moves back to the previous step. The player is given three opportunities to answer the baseball trivia question correctly, and if the player fails to do so, the result is an out for the player. The player is given three outs per turn with the player having nine turns which simulates a nine inning baseball game. Upon answering the baseball trivia question correctly, the player then selects a card from the second deck of playing cards 21 to determine the outcome for positioning one's game pieces 22 about the simulated diamond-shaped playing field 13 and for keeping track of scores upon the game pieces 22 reaching the simulated home base 17. The player continues to select cards from the first deck of cards 20, and upon answering the trivia questions correctly, selects cards from the second deck of playing cards 21 until the game is over with the player tallying the highest scores after nine turns winning the game.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the baseball board and trivia game. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of playing a baseball board and trivia game includes the step of:

providing a game board having a top side and further having a simulated diamond-shaped playing field diagrammed upon said top side and including simulated first, second and third bases and a simulated home base being diagrammed upon said simulated diamond-shaped playing field, and also providing decks of playing cards including a first deck of playing cards each having a baseball trivia question and answer displayed upon a side thereof, and also including a second deck of playing cards each having a particular baseball play outcome being displayed upon a side thereof, and further providing a plurality of game pieces being movably positioned upon said game board;

selecting a card from said first deck of playing cards;

answering said baseball trivia question either correctly and moving on to a next step or incorrectly and moving back to the previous step and being given three opportunities to answer said baseball trivia question correctly and failing to do so results in an out for a particular player, each player being given three outs per turn with each said player having nine turns which simulates a nine inning baseball games;

selecting a card from said second deck of playing cards to determine an outcome for one's said game pieces; and repeating the steps of selecting a card from said first deck of playing cards, answering said baseball trivia question, and selecting a card from said second deck of playing cards until game is over.

2. A method of playing a baseball board and trivia game as described in claim 1, wherein the step of selecting a card from said second deck of playing cards includes the step of positioning one's game pieces about said simulated diamond-shaped playing field and keeping track of scores upon said game pieces reaching said simulated home base.

3. A method of playing a baseball board and trivia game as described in claim 2, wherein the step of repeating steps 2 through 4 includes the step of tallying said scores and the player having the highest score after said nine turns wins the game.

* * * * *